United States Patent [19]

van den Broek

[11] 4,445,451

[45] May 1, 1984

[54] DOCK DEVICE

[75] Inventor: Bernardus C. van den Broek, Weert, Netherlands

[73] Assignee: Stork Services B.V., Hengelo, Netherlands

[21] Appl. No.: 290,251

[22] Filed: Aug. 5, 1981

[30] Foreign Application Priority Data

Aug. 14, 1980 [NL] Netherlands ..... 8004610

[51] Int. Cl.[3] ..... B63B 59/00

[52] U.S. Cl. ..... 114/222; 51/429; 118/108; 118/207; 118/305

[58] Field of Search ..... 114/222; 180/199, 200; 15/302, 49 R, 50 R; 51/429; 118/108, 207, 305

[56] References Cited

U.S. PATENT DOCUMENTS

| | | | |
|---|---|---|---|
| 3,738,284 | 6/1973 | Atsuta et al. | 180/200 |
| 3,951,092 | 4/1976 | van den Broek | 114/222 |
| 4,270,484 | 6/1981 | Shimatani et al. | 118/305 |

FOREIGN PATENT DOCUMENTS

| | | |
|---|---|---|
| 2216797 | 8/1974 | France . |
| 2324490 | 4/1977 | France . |
| 2378713 | 8/1978 | France . |
| 2441578 | 6/1980 | France . |
| 1337059 | 11/1973 | United Kingdom . |

*Primary Examiner*—Sherman D. Basinger
*Attorney, Agent, or Firm*—Diller, Ramik & Wight

[57] ABSTRACT

A dock device having a bottom for supporting a ship or the like and longitudinal walls standing up from the bottom, a carriage adapted to be moved along a longitudinal wall, an arm pivotably and deflectably connected with the carriage, swinging and deflecting mechanism for moving the arm with respect to the carriage, a head carrying a processing member and being rotatably and tiltably connected with the free end of said arm and tilting and rotating mechanism for moving said head with respect to the arm. Horizontal and vertical guide wheels on the head are alternately actuated by setting mechanism connected with the head.

13 Claims, 8 Drawing Figures

DOCK DEVICE

BACKGROUND OF THE INVENTION

The invention relates to a dock device comprising a bottom for supporting a ship or the like and longitudinal walls rising up from the bottom, a carriage adapted to travel along a longitudinal wall by driving means, an arm pivotally and deflectably connected with said carriage, swinging and deflecting means for moving said arm with respect to the carriage, a head carrying a processing member and being rotatably and tiltably connected with the free end of the arm and tilting and rotating means for moving said head with respect to the arm.

In order to ensure a satisfactory operation of the processing member concerned it has, in general, to be held at a fixed, constant distance from the wall to be treated. From French Patent Application No. 2,441,578 a dock device of the kind set forth is known, in which said constant distance is maintained by means of swivelling wheels mounted on the head. It has been found that such swivelling wheels do not satisfactorily guide the head. As a result the treatment of the wall by means of processing member is less satisfying.

BRIEF SUMMARY OF THE INVENTION

The invention has for its object to provide a device of the kind set forth in the preamble, which does not exhibit said disadvantage.

This is achieved by connecting with the head horizontal and vertical guide wheels to be alternately actuated by setting means. It has been found that in order to obtain a satisfactory operation of swivelling wheels the pivotal axis thereof has to be invariably at right angles to the surface along which the wheel is moving. It will be obvious that this cannot be ensured for a travel along an arcuate ship's hull. In treating a ship's hull the processing member usually moves on horizontal "paths" along the ship's hull; according to the invention the horizontal guide wheels held in contact with the wall by the setting means guide the processing member uniformly and accurately. When changing over to another "path" in a vertical sense, the vertical guide wheels are caused to contact the wall.

A particularly advantageous embodiment of the invention is obtained by coupling the setting means with the deflecting means and the driving means so that the appropriate guide wheels are automatically held in contact with the ship's hull.

When, in addition, the swinging and deflecting means are relatively blocked so that each time at least one of said means is out of operation, it is ensured that the guide wheels will never be loaded transversely of the direction of run.

In order to ensure a satisfactory operation the processing member has usually to be directed on the ship's hull at a given angle to the direction of movement. In order to allow the processing member to operate in both directions of movement of the carriage, directing means have to be connected with the processing member. According to a further aspect of the invention said directing means are coupled with the driving means for the sets of wheels so that the direction of operation of the processing member automatically matches the direction of movement of the head along the wall.

Further features and advantages of the invention will be apparent from the following description of an embodiment of the device with reference to the drawings.

BRIEF DESCRIPTION OF THE DRAWING FIGURES

DETAILED DESCRIPTION OF THE INVENTION

Figure 1:
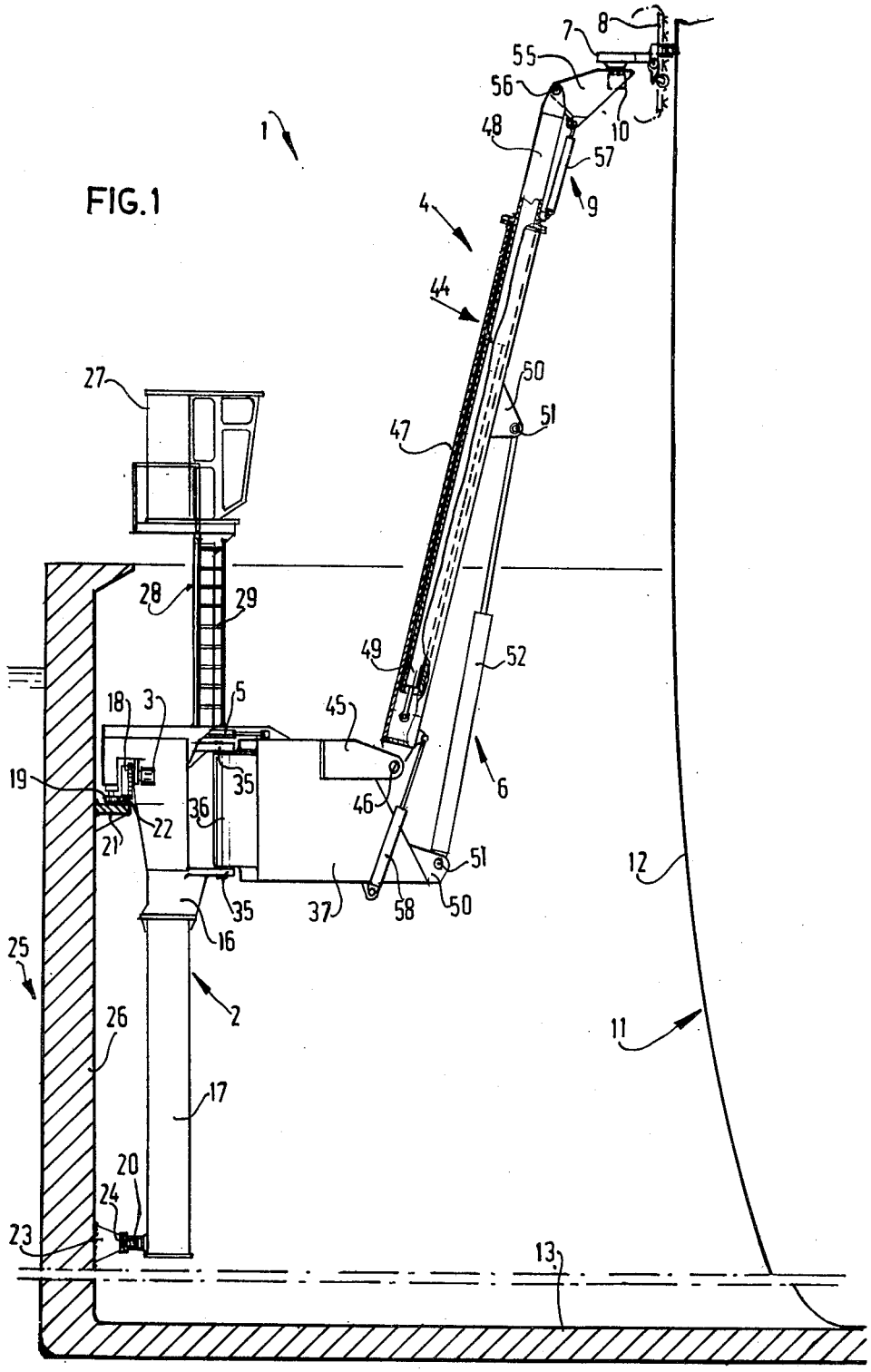
FIG. 1 is a partial secional view and a side elevation of the device embodying the invention.
Figure 2:
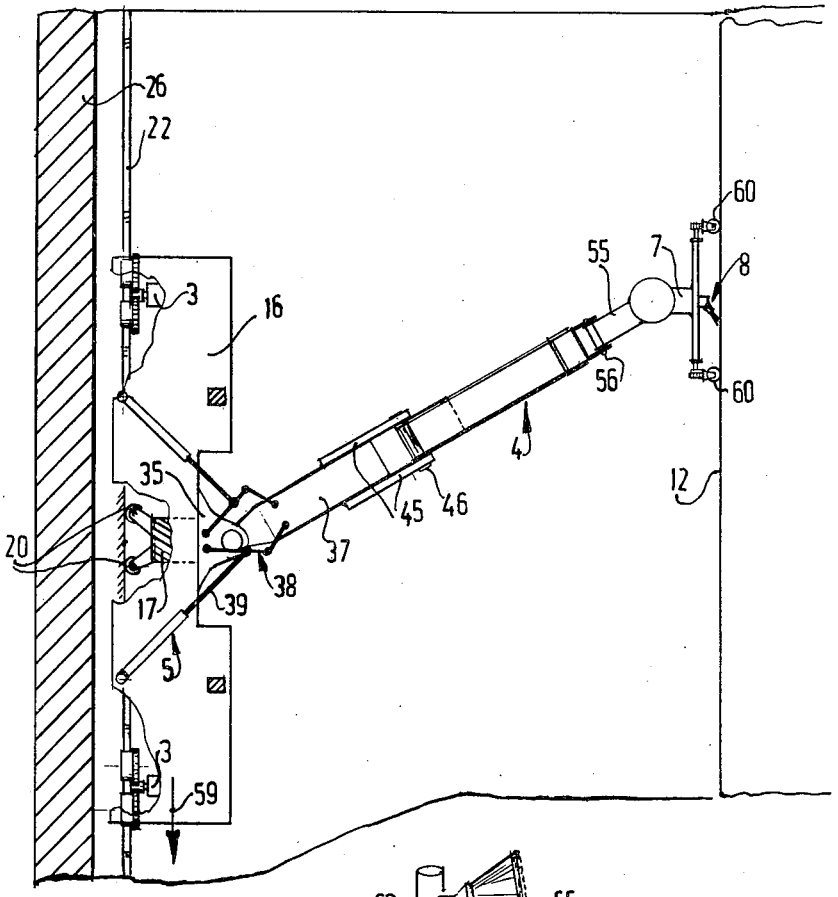
FIG. 2 is a plan view, partly broken away, of the device shown in FIG. 1.

The dock device 1 according to the invention comprises a dock 25 having a bottom 13 for supporting a ship 11 or the like and longitudinal walls 26 standing on the bottom 13 and a carriage 2 adapted to travel along the wall 26. The carriage 2 comprises to this end driving means 3. The device furthermore comprises an arm 4, which can move a head 7 to any desired place near the ship's hull 12 by swinging means 5 and deflecting means 6. The head 7 carries a processing member 8 for treating the ship's hull. The head 7 can be set in a desired angular position by tilting means 9 and rotating means 10.

The carriage 2 comprises a substantially horizontal chassis 16, to the underside of which a leg 17 is mounted at the centre. The chassis 16 has mounted on it at each end a set of carrying wheels 18 and a supporting wheel 19. The wheels 18 located in a vertical plane bear on an upper rail 22, which is arranged by means of rail support 21 on the wall 26 of the dock 25. The horizontal supporting wheels 19 grip behind said upper rail 22. At the lower end of the leg 17 are provided further horizontal, reactive wheels 20, which co-operate with a lower rail 24, which is fastened by means of rail supports 23 to the dock wall 26.

By causing the driving means 3, to rotate the carrying wheels 18, the carriage 2 can be moved with the arm 4 along the dock wall 26 and along the hull 12 of the ship 11 located therein. The carriage 2 is provided by means of a console 28 with a control-cabin 27. The carriage 2 is accessible by a ladder 29 arranged between the control-cabin 27 and the carriage 2.

The chassis 16 is provided with vertical, relatively spaced pivotal shaft supports 35 holding a pivotal shaft 36. The pivotal shaft extends across the swinging body 37 of the arm 4 so that the arm 4 can turn about the pivotal shaft 36. This swinging movement is brought about by the swinging means 5 comprising rod transmission sets 38 and swinging cylinders 39.

Since the swinging means 5 comprise said rod transmissions 38 an overall angle of swing of the arm 4 of about 180° can be obtained, whilst the swinging means 5 constitute a compact structure and the cylinders 39 have a limited stroke.

On the top side of the swinging body 37 are arranged deflecting shaft supports 45. The support 45 hold the deflecting shaft 46, which deflectably supports the gig 44 of the arm 4. The gig 44 comprises an inner gig 48, which is telescopically slidable in an outer gig 47. By means of the extension cylinder 49 the inner gig 48 can be moved out into the outer gig 47. The swinging body 37 on the one hand and the outer gig 47 on the other hand are provided with deflecting cylinder supports 50, between which the deflecting cylinder 52 is pivotally mounted by means of pivotal shafts 51.

With the top end of the inner gig 48 is connected by means of a tilting shaft 56 a head carrier 55. The head carrier 55 carries the head 7, which is connected through the rotating means 10 with the head carrier 55. The tilted position of the head carrier 55 is determined by the tilting means 9, which comprise an upper tilting cylinder 57 and a lower tilting cylinder 58. The upper tilting cylinder 57 and the lower tilting cylinder 58 are interconnected and proportioned so that a tilted position of the head carrier 55 once chosen is maintained independently of the deflecting position of the gig 44.

The various moving means such as the driving, swinging, deflecting, tilting and rotating means can all be actuated by a single operator in the control-cabin 27.

The processing member 8 may comprise a spray boom for high-pressure cleaning of the ship's hull 12 or, for example, a grit jet pipe or a paint sprayer.

During the treatment of the ship's hull 12 the head 7 is urged with the guide wheels 60 against the hull 12 and the processing member 8 is passed along the wall by driving the carriage 2 along the rails 22, 24 in the direction of the arrow 59. For reasons of safety it is preferred to move the head 7 always in a "trailing" position.

In treating the ship's hull 12 the head 7 is resiliently brought into contact with the hull 12 by the arm 4. The guide wheels 60 roll along the wall. The set of guide wheels 60 comprises horizontal guide wheels 82 and vertical guide wheels 81 for a horizontal movement of the head 7 along the wall and a vertical movement thereof respectively. In accordance with the desired movement of the head 7 along the wall 12 the guide wheels concerned are brought into contact with the wall by setting means 76. The setting means 76 comprise a setting shaft 79 rotatably journalled in a support 78 of the head 7, a tilting arm 83 rigidly fastened to the setting shaft 79 and setting cylinder 85 engaging the end of the tilting arm 83, the opposite end of said cylinder being fastened in a support 86 rigidly connected with the head 7. To both ends of the setting shaft are fastened wheel arms 80, each of which carries a horizontal wheel 82 and a vertical wheel 81. By means of the setting cylinder 85 the wheel arms can be set in two positions, in which the horizontal wheels 82 or, respectively, the vertical wheels 81 can come into contact with the wall 12. Preferably the setting cylinder 85 is coupled with the deflecting means and the driving means of the device in a manner such that the appropriate guide wheel 81, 82 is automatically in the operative position.

Figure 5:
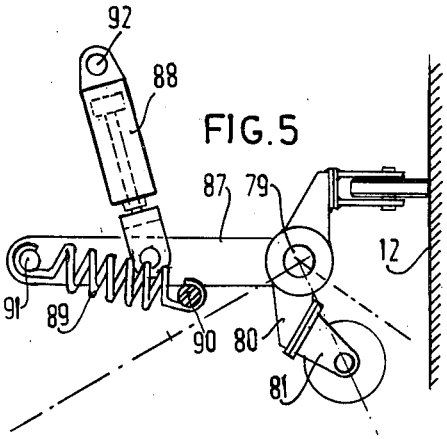
FIG. 5 is an enlarged, schematic view of an alternative embodiment of a set of guide wheels.

In the alternative embodiment of FIG. 5 the setting cylinder 88 need not be continuously subjected to pressure for maintaining the contact between the appropriate guide wheel 81, 82 and the ship's hull to be treated. The set cylinder 88, which is pivotally connected at 92 with the head 7, engages a setting arm 87, which is rigidly connected with the setting shaft 79 or a wheel arm 80. The end of the setting arm 87 is provided with a pin 91, engaged by a tensile spring 89. The other end of the tensile spring 89 is arranged around a fastening point 90, which is rigidly connected with the head 7. The fastening point 90 is situated so that the imaginary line of connection between the centre of the pin 91 and the centre of the setting shaft 79 is located above the fastening point 90 in the position in which the horizontal wheel 82 is in contact with the wall 12 and below the same in the position in which the vertical wheel 81 is in contact with the wall 12. It is thus ensured that the two above-mentioned positions are stable and that the set cylinder 88 need only be energized when a different position has to be set.

Figure 3:
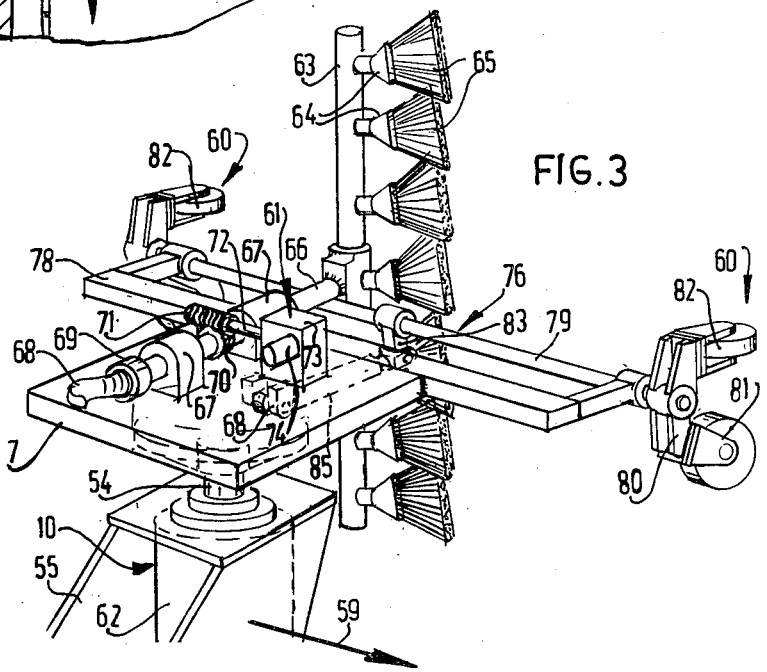
FIG. 3 is an enlarged, perspective view of the head of the device shown in the preceding Figures with a spray boom arranged thereon.

FIG. 3 shows that the rotating means 10 are formed by a motor 62, on the output shaft 54 of which is mounted the head 7. The motor 62 is preferably a hydro-motor. The head 7 is provided with a spray boom 63 for cleaning the ship's hull. The spray boom 63 has a plurality of spray nozzles 64 producing a fan-like jet 65. The fluid to be sprayed, usually high-pressure water, is fed by a duct 68, which communicates through a coupling 69 with the hollow transverse shaft 66, which opens out midway the spray boom 63. The coupling 69 may be of a type allowing relative rotation of the coupled parts.

In order to obtain a satisfactory cleaning effect the spray nozzles 64 have to be directed at an acute angle to the ship's hull in the direction of movement (arrow 59). In order to permit the spray boom 63 of operating in the two directions of movement i.e. in the direction indicated by the arrow 59 and in the opposite direction, the spray boom 63 is connected with the directing means 61 by which the spray boom 63 with the jets 65 can be directed in the direction of propagation.

In the embodiment shown in FIG. 3 this is achieved in that the spray boom 63 is capable of turning through 180° about the transverse shaft 66. For this purpose the transverse shaft 66 is rotatably mounted in bearing blocks 67 provided on the head 7. The transverse shaft 66 is provided with a worm wheel 70 engaged by a worm 71, which is provided on the output shaft 72 of a driving gear 73 mounted on the head 7 and coupled with a motor 74.

The setting means 61 are preferably coupled with the driving means 3 in a manner such that the spray nozzles 64 are automatically adjusted to the appropriate direction at a change-over of the direction of movement.

Figure 7:
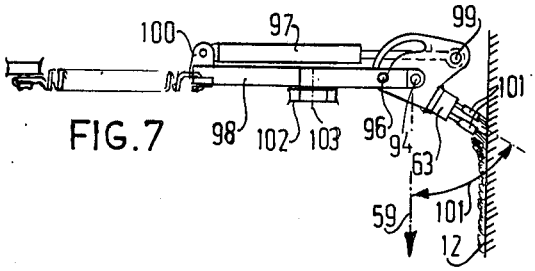
FIG. 7 is a plan view of the elements of FIG. 6.
Figure 4:
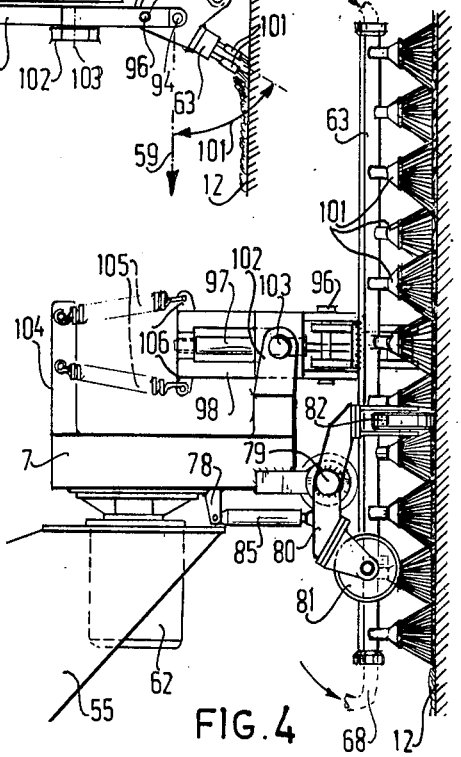
FIG. 4 is a side elevation of the head with a spray boom in a different embodiment.
Figure 6:
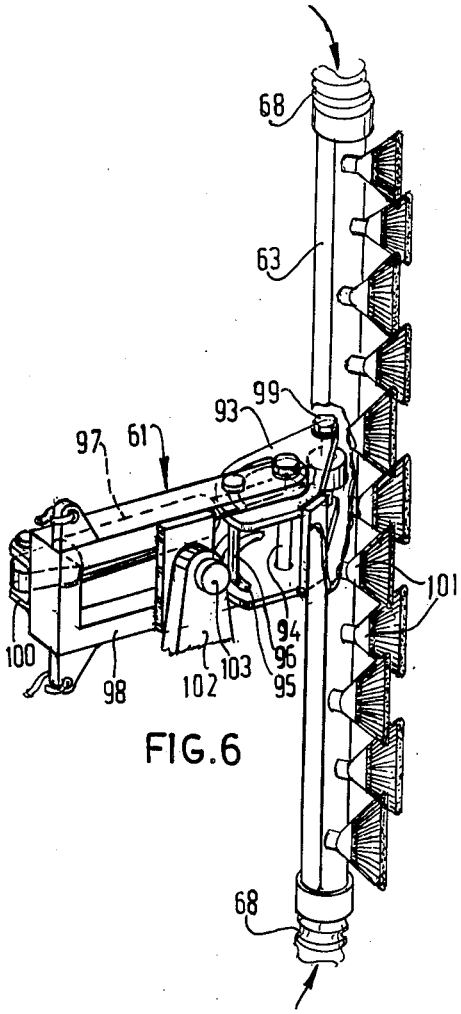
FIG. 6 is a partial, perspective view of the element shown in FIG. 4.

FIGS. 4, 6 and 7 show an embodiment in which the spray boom 63 is turned about its longitudinal axis in order to direct the spray nozzles 101 in accordance with the direction of travel of the carriage 2. To the spray boom 63 are fastened rotatable supports 93. The rotatable supports 93 are rotatable by means of a hinge bolt 94 in a fork 98. A directing cylinder 97 engages by a bolt 99 on the one hand a protruding part of the rotatable supports 93 and on the other hand supports 100 fastened to the fork 98. By sliding the cylinder 97 inwards and outwards respectively the rotatable supports and hence the spray boom 63 are turned about the hinge bolt 94. The rotatable supports 93 have arcuate slots 95, through which extends a pin 96 connected with the fork 98. Thus the stroke of the rotatable supports 93 with the spray boom 63 is limited. In FIG. 7 the arrow 101 indicates the angle between the spray nozzles and the direction of movement indicated by the arrow 59. This angle is preferably about 60°, since this ensures a maximum cleaning effect of the jets.

In this embodiment the fork 98 is journalled in a hinge support 102 rigidly fastened to the head 7 so as to be rotatable about a pivotal shaft 103 extending in the direction of movement along the wall 12. The fork 98 is held by springs 105 in a horizontal position and hence the spray boom 63 in a vertical position. The springs 105 engage each by one end an eyelet 106 of the fork 98 and by the other end a spring support 104 of the head 7.

By this construction the position of the spray boom 63 can match the wall 12. When the distance between the spray nozzles and the wall 12 becomes so small that the jet emanating from the nozzle concerned is disturbed, the reactive force of the emanating jet on the spray boom 63 increases so that the spray boom 63 with the fork 98 will turn about the pivotal shaft 103 until a new state of equilibrium is established. In practice the pressure at which water or another detergent fluid is sprayed out of the nozzles is more than 300 bar, whilst the rate of flow from each nozzle amounts to a few tens of liters of water per minute. Therefore, the reactive forces produced are considerably high.

In order to avoid that the fan-like jets 75 come into contact with one another and would thus adversely affect their operations, the nozzles are relatively turned as is shown in FIG. 3 are relatively off-set as is shown in FIGS. 4 and 6 on the spray boom 63.

Figure 8:
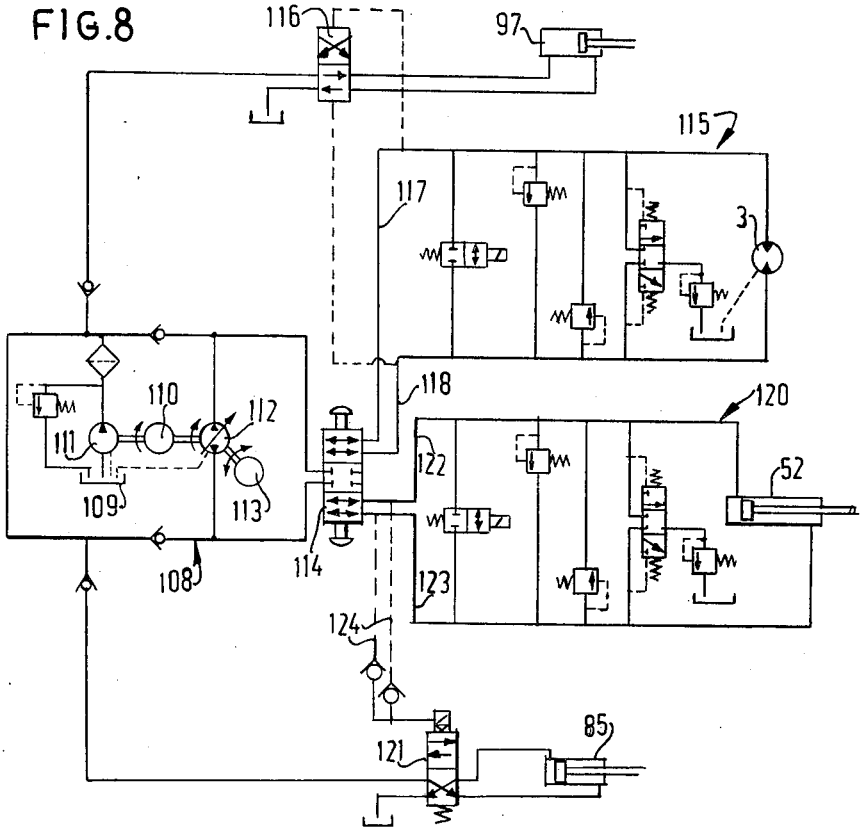
FIG. 8 is a simplified basic diagram of a potential, hydraulic control-circuit.

The co-operation of a number of moving means according to the invention will be explained with reference to the simplified circuit diagram of FIG. 8. FIG. 8 shows a feeding circuit 108 which can be connected through a selection slide 114 with a driving motor circuit 115 or a deflecting cylinder circuit 120.

The feeding circuit 108 comprises a feeding pump 111 driven by a master motor 110. The feeding pump 111 draws hydraulic oil from a reservoir 109 and presses the same into the circuit. With the master motor 110 is also connected a controllable and commutatable control-pump 112, the displacement capacity of which as well as the direction is determined by the control-motor 113. The driving motor circuit 115 comprises the driving means 3 formed by a hydro-motor and conventional safety elements as required. When the selection slide 114 of FIG. 8 is set in the down position, so that the feeding circuit is directly coupled with the driving motor circuit 115, the driving motor 3 becomes operative. By regulating the control-pump 112 by means of the control-motor 113 the direction of movement and the speed of the carriage 2 can be regulated. This means that the speed of the carriage 2 can be continuously varied between standstill and a given maximum speed in both directions. With the ducts 117, 118 of the driving motor circuit 115 is coupled a hydraulically actuated change-over flap 116, which controls the supply and evacuation of hydraulic oil for the directing cylinder 97. When the control-pump 112 is in a position such that the duct 118 is the pressure duct, the change-over flap 116 is in the position shown and the directing cylinder 97 is maintained under pressure in the extended position. When the direction of operation of the pump 112 is changed over for inverting the direction of rotation of the motor 3 and hence the direction of the carriage 2, the duct 117 becomes the pressure duct and the change-over slide 116 is set in the down position so that the directing cylinder 97 is moved inwardly. In this way the direction of spraying of the spray boom is automatically caused to correspond to the direction of movement of the carriage.

In this situation in which the selection slide 114 connects the feeding circuit 108 with the driving motor circuit 115, no feed pressure is exerted on the deflecting cylinder circuit 120. The change-over flap 121 is, therefore, owing to the spring pressure in the position shown in FIG. 8. This change-over flap 121 controls the supply and withdrawal of hydraulic oil for the setting cylinder 85. In this position of the set cylinder 85 the horizontal guide wheels 82 are in contact with the ship's hull to be treated.

By moving the change-over slide 114 in FIG. 8 into the upper position, the driving motor 3 is switched off and the deflecting cylinder 52 can be continuously actuated in both directions. One of the ducts 122 and 123 is then either the supply duct or the evacuation duct. The feeding pressure is exerted on the change-over flap 121 through the control-ducts 124 including non-return valves so that the change-over flap 121 of FIG. 8 moves into the down position and the set cylinder 85 moves the vertical guide wheels 81 into contact with the ship's hull. As soon as the selection slide 114 is again moved into the position for actuating the driving motor 3, the change-over flap 121 is moved by the spring pressure into the position shown as a result of which the set cylinder 85 again moves the horizontal guide wheels 82 into contact with the ship's hull.

According to the invention, since by means of the selection slide 114 each time only the driving motor 3 providing the horizontal movement of the head 7 or only the deflecting cylinder 52 providing the vertical movement thereof is switched on and, moreover, the guide wheels 81 and 82 associated with said movements are automatically actuated, it is ensured that the guide wheels will never be loaded transversely of their movement of run.

Since the rotation of the driving motor 3 is continuously variable in both directions, the processing member can be moved at any desired, constant speed along the wall to be treated. This is particularly important when the processing member comprises a paint sprayer because the quality of the applied layer of paint depends on the rate of propagation and the uniformity thereof. When the processing member is a high-pressure spray boom or a grit jet pipe, an optimum speed can be adjusted.

What I claim is:

1. A dock device comprising a bottom for supporting a ship or the like and longitudinal walls standing up from the bottom, a carriage adapted to be moved by driving means along a longitudinal wall, an arm pivotably and deflectably connected with the carriage, swinging and deflecting means for moving the arm with respect to the carriage, a head carrying a processing member and being rotatably and tiltably connected with the free end of said arm and tilting and rotating means for moving said head with respect to the arm, characterized in that horizontal and vertical guide wheels to be alternately actuated by setting means are connected with the head, each of said wheels being journalled on said head about an axis which is fixed relative to such head.

2. A device as claimed in claim 1, characterized in that the setting means are coupled with the deflecting means and the driving means.

3. A device as claimed in claim 2, characterized in that the swinging and deflecting means are relatively blocked so that each time at least one of said means is out of operation.

4. A device as claimed in claim 3, characterized in that the processing member comprises directing means coupled with the setting means for the sets of wheels.

5. A device as claimed in claim 2, characterized in that the processing member comprises directing means coupled with the setting means for the sets of wheels.

6. A device as claimed in claim 1, characterized in that the swinging and deflecting means are relatively blocked so that each time at least one of said means is out of operation.

7. A device as claimed in claim 1, characterized in that the processing member comprises directing means coupled with the setting means for the sets of wheels.

8. In a dock device adapted to support the hull of a maritime vessel and including a carriage having a boom carried thereby for rotation about horizontal and vertical axes, track means for guiding said carriage back and forth along a given path, a processing member carried by said boom, actuating means for raising and lowering said boom whereby said processing member is located at different levels with respect to the hull, and drive means for traveling said carriage back and forth along said path, the improvement wherein:

said processing member includes a movable support and first actuator means for positioning said support in either one of two positions, horizontal wheel means rotatably carried by said support about a vertical axis for engagement with the hull only in one of the two positions of said movable support and vertical wheel means rotatably carried by said support about a horizontal axis for engagement with the hull only in the other of said two positions of said movable support, and control means for causing said first actuator means to move said support to said other position thereof when said actuating means is enabled and for causing said first actuator means to move said support to said one position thereof when said actuating means is disabled.

9. In a dock device as defined in claim 8 wherein said processing member includes a spray head movable between first and second positions, and second actuator means for moving said spray head to either one of said first and second positions, said control means including direction control means for selecting the direction of movement of said carriage along said path, and means responsive to selection of one direction of movement of said carriage for causing said second actuator means to move said spray head to its first position and responsive to selection of the opposite direction of movement of said carriage, for causing said second actuator means to move said spray head to its second position.

10. In a dock device as defined in claim 9 wherein said control means disables said actuating means when said drive means is enabled and vice versa.

11. In a dock device as defined in claim 10 wherein said spray head is vertically elongate and is mounted for rocking movement about a horizontal axis.

12. In a dock device as defined in claim 8 wherein said first actuator means comprises a double acting hydraulic piston/cylinder.

13. In a dock device as defined in claim 8 wherein said first actuator means comprises a spring device normally urging said support to said other position thereof and a single acting hydraulic piston/cylinder for urging said support to said one position thereof.

* * * * *